US010439339B2

(12) United States Patent
Motohashi et al.

(10) Patent No.: US 10,439,339 B2
(45) Date of Patent: Oct. 8, 2019

(54) COAXIAL CONNECTOR WITH A LOCKING MEMBER ATTACHED TO THE HOUSING

(71) Applicant: Molex, LLC, Lisle, IL (US)

(72) Inventors: Nobumasa Motohashi, Yamato (JP); Takeshi Kon, Yamato (JP); Manabu Yamanaka, Yamato (JP); Ryotaro Takeuchi, Yokohama (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/994,109

(22) Filed: May 31, 2018

(65) Prior Publication Data

US 2018/0366887 A1 Dec. 20, 2018

(30) Foreign Application Priority Data

Jun. 14, 2017 (JP) ..... 2017-116988

(51) Int. Cl.

| | |
|---|---|
| ***H01R 24/38*** | (2011.01) |
| *H01R 103/00* | (2006.01) |
| *H01R 13/434* | (2006.01) |
| *H01R 13/658* | (2011.01) |
| *H01R 13/6592* | (2011.01) |
| *H01R 9/05* | (2006.01) |
| *H01R 13/504* | (2006.01) |

(52) U.S. Cl.

CPC ..... *H01R 24/38* (2013.01); *H01R 9/05* (2013.01); *H01R 13/434* (2013.01); *H01R 13/504* (2013.01); *H01R 13/658* (2013.01); *H01R 13/6592* (2013.01); *H01R 2103/00* (2013.01)

(58) Field of Classification Search

CPC ..... H01R 13/6592; H01R 13/658; H01R 13/504; H01R 9/05; H01R 24/38

USPC ..... 439/578, 607.45, 607.48, 607.5, 607.51, 439/607.52

See application file for complete search history.

(56) References Cited

U.S. PATENT DOCUMENTS

| | | | | |
|---|---|---|---|---|
| 7,285,011 | B2 * | 10/2007 | Hardy | H01R 13/506 439/582 |
| 7,980,894 | B1 | 7/2011 | Hall et al. | |
| 2016/0134032 | A1 * | 5/2016 | Hall | H01R 9/0518 439/578 |

FOREIGN PATENT DOCUMENTS

| | | | |
|---|---|---|---|
| JP | 2007-123273 | A | 5/2007 |

* cited by examiner

*Primary Examiner* — Abdullah A Riyami
*Assistant Examiner* — Justin M Kratt
(74) *Attorney, Agent, or Firm* — Molex, LLC

(57) ABSTRACT

A shield terminal includes a contact part surrounding a center terminal and a dielectric body and configured to come into contact with a terminal of a target connector, a connecting part surrounding a shield wire and connected to the shield wire, and a catching-target part surrounding a coaxial cable. The contact part, the connecting part, and the catching-target part are bent and formed integrally into a cylindrical shape to surround a center line of the coaxial cable. A housing includes, inside an insertion hole, a catching face configured to come into contact with a part of a front edge of the catching-target part to restrict the shield terminal from moving forward.

24 Claims, 15 Drawing Sheets

COAXIAL CONNECTOR WITH A LOCKING MEMBER ATTACHED TO THE HOUSING

RELATED APPLICATIONS

This application claims priority to Japanese Application No. 2017-116988, filed Jun. 14, 2017, which is incorporated herein by reference in its entirety.

TECHNICAL FIELD

The present disclosure relates to a coaxial connector.

BACKGROUND ART

A coaxial connector includes a center terminal connected to a core wire of a coaxial cable, a shield terminal having a cylindrical shape and connected to a shield wire of the coaxial cable, and a housing inserted with the center terminal and the shield terminal. Some coaxial connectors allow a coaxial cable, a center terminal, and a shield terminal to rotate (Patent Document 1, described below). With such a connector, even when a twisting force is applied to a coaxial cable, the coaxial cable can rotate, mitigating a burden applied to the coaxial cable.

Patent Document 1: Japanese Unexamined Patent Publication No. 2007-123273

SUMMARY

Examples of conventional structures allowing a coaxial cable to rotate are described below. On an outer face of a shield terminal having a cylindrical shape, two annular projection parts separated from each other in a front-rear direction are formed. The annular projection parts are formed over a whole circumference of the shield terminal so as to surround a coaxial connector. A housing is attached with a locking member. An engaging part of the locking member fits to the two annular projection parts. When the annular projection parts and the locking member engage each other, i.e., when the engaging part of the locking member is disposed between the two annular projection parts, the shield terminal is restricted from moving in the front-rear direction, while the shield terminal is allowed to rotate. Such a conventional shield terminal has been formed by cutting a metallic column made of brass, for example, requiring a greater cost due to cutting. Another possible shield terminal having a cylindrical shape including annular projection parts may be produced by press working a metallic plate. However, forming annular projection parts through press working is difficult, increasing a cost. Further, the annular projection parts of the shield terminal might sacrifice electric characteristics (impedance).

An object of the present disclosure is to propose a structure capable of improving electric characteristics and of reducing a production cost for a coaxial connector.

(1) A coaxial connector according to one embodiment proposed in the present disclosure includes a center terminal connected to a core wire of a coaxial cable, a shield terminal connected to a shield wire of the coaxial cable, a dielectric body externally surrounding the center terminal and disposed between the center terminal and the shield wire, a housing formed with an insertion hole passing through in a front-rear direction to accommodate the center terminal, the dielectric body, and the shield terminal. The housing is inserted with the center terminal, the dielectric body, and the shield terminal from a rear side of the insertion hole. The shield terminal includes a contact part surrounding the center terminal and the dielectric body and configured to come into contact with a terminal of a target connector, a connecting part surrounding the shield wire of the coaxial cable and connected to the shield wire, and a catching-target part surrounding the coaxial cable. The contact part, the connecting part, and the catching-target part are formed integrally into a cylindrical shape bent to surround a center line of the coaxial cable. The housing includes, inside the insertion hole, a catching part configured to come into contact with a part of a front edge of the catching-target part to restrict the shield terminal from moving forward.

(2) In the coaxial connector according to (1), the catching-target part of the shield terminal may lie behind the connecting part.

(3) In the coaxial connector according to (2), the contact part of the shield terminal may include a main body surrounding the center terminal and the dielectric body, and a rearmost part lying behind the main body and surrounding the shield wire.

(4) In the coaxial connector according to any one of (1) to (3), the catching part of the housing surrounds the center line of the coaxial cable, and the catching-target part of the shield terminal is rotatable over 360 degrees relative to the catching part about the center line of the coaxial cable.

(5) In the coaxial connector according to any one of (1) to (4), the catching-target part may include, at a part of the catching-target part in a circumferential direction about the center line of the coaxial cable, a first curved part connected to the connecting part and curved about the center line, and a second curved part at another part of the catching-target part in the circumferential direction. A distance from the center line to the second curved part may be longer than a distance from the center line to the first curved part. A front edge of the second curved part may be in contact with the catching part of the housing.

(6) In the coaxial connector according to any one of (1) to (5), a locking member attached to the housing may be included. The locking member may include a catching part lying behind a rear edge of the catching-target part. The catching part may be configured to restrict the shield terminal from moving rearward.

(7) In the coaxial connector according to any one of (1) to (6), the catching-target part may lie at a rearmost part of the shield terminal.

(8) In the coaxial connector according to any one of (1) to (7), inside the connecting part of the shield terminal, a supporting member having a cylindrical shape surrounding the shield wire may be disposed.

(9) In the coaxial connector according to (8), the shield wire may include a folded part folded outward of the supporting member. The connecting part of the shield terminal may be disposed outside the folded part.

(10) In the coaxial connector according to (8), the supporting member may include a shield wire holding part surrounding the shield wire to hold the shield wire, and an outer coat holding part surrounding an outer coat of the coaxial cable to hold the outer coat.

(11) In the coaxial connector according to (10), the catching-target part of the shield terminal may lie outside the outer coat holding part so as to be away from the outer coat holding part in a radial direction of the coaxial cable.

(12) In the coaxial connector according to any one of (1) to (11), the shield wire may lie inside the catching-target part.

(13) In the coaxial connector according to any one of (1) to (12), at least a part of the catching-target part in the circumferential direction about the center line of the coaxial cable may be away from an outer face of the coaxial cable.

DETAILED DESCRIPTION OF THE PREFERRED EMBODIMENTS

Figure 1:
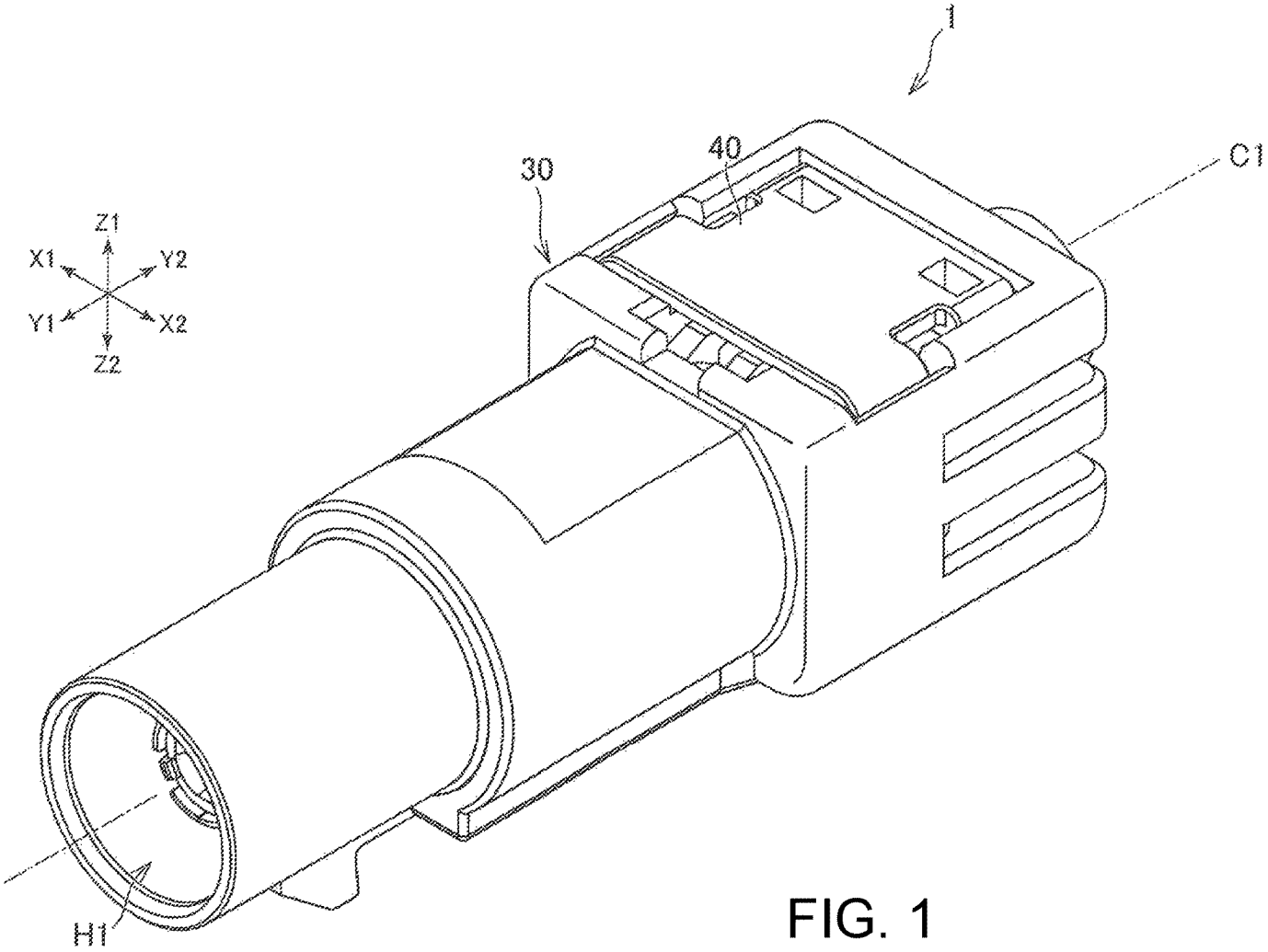
FIG. 1 is a perspective view illustrating an example of a coaxial connector proposed in the present disclosure.

Hereinafter, embodiments of a coaxial connector proposed in the present disclosure will now be described. In the below description, directions illustrated with Y1 and Y2 in FIG. 1 respectively denote forward and rearward. Directions illustrated with Z1 and Z2 in FIG. 1 respectively denote upward and downward. Directions illustrated with X1 and X2 in FIG. 1 respectively denote right direction and left direction.

Figure 4A:
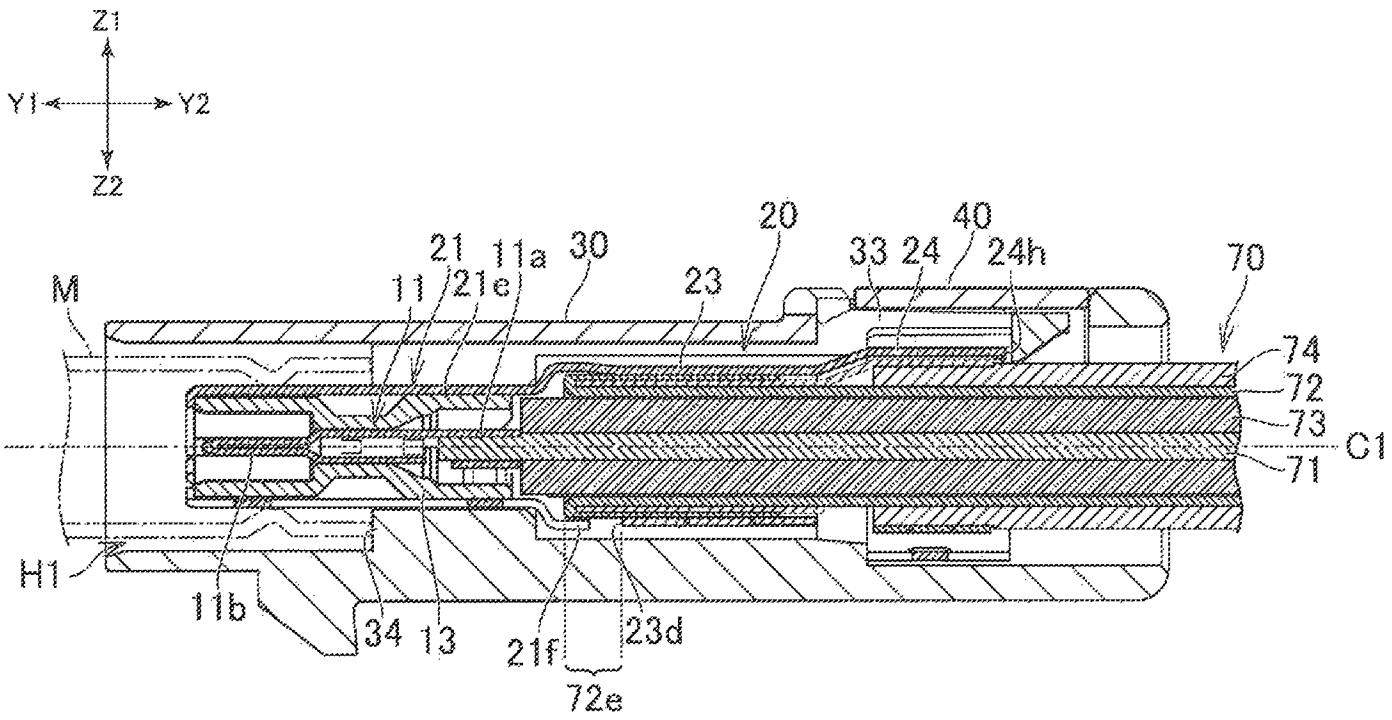
FIG. 4A is a cross-sectional view taken along line IV-IV in FIG. 3.
Figure 7:
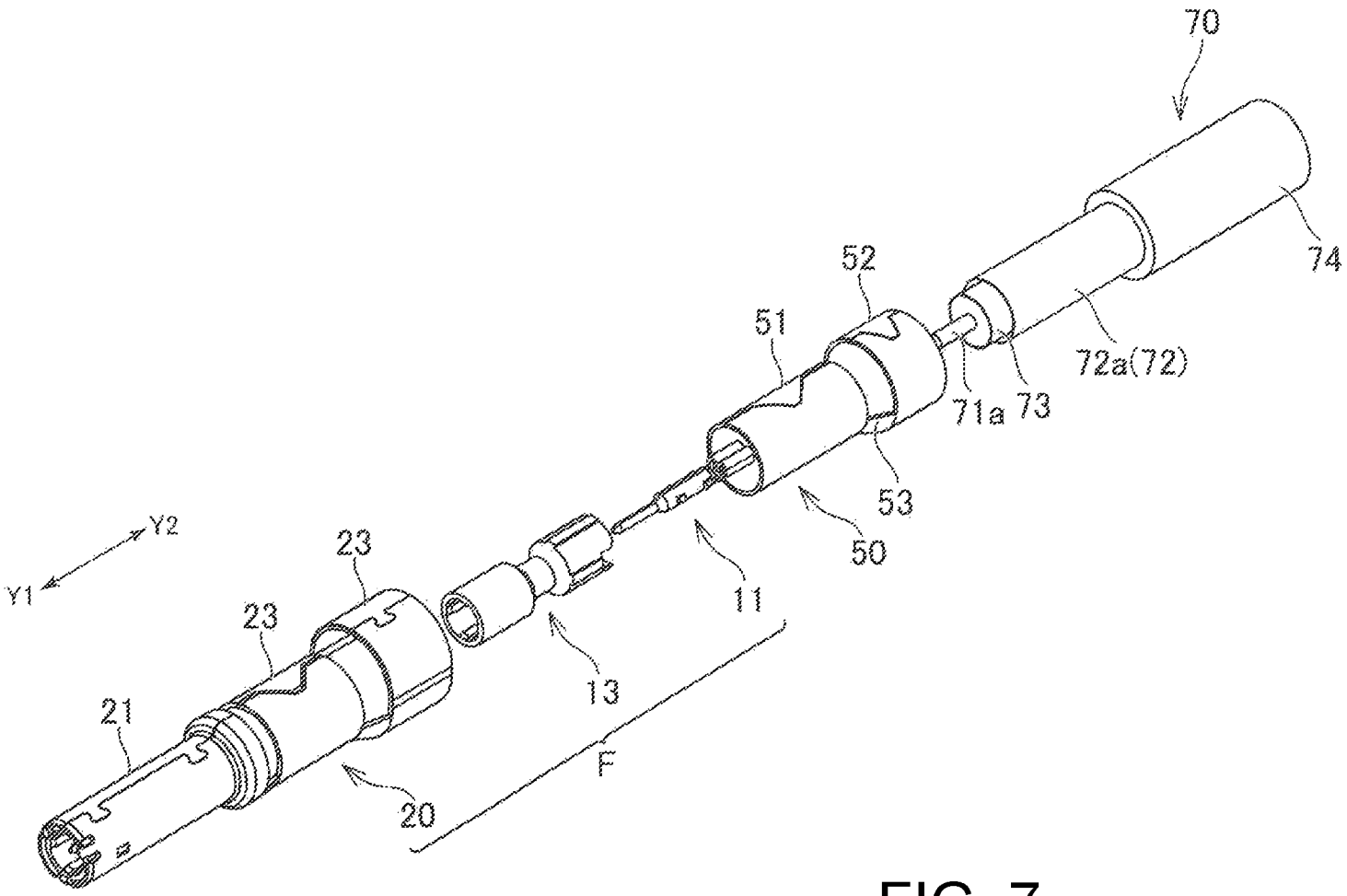
FIG. 7 is an exploded perspective view of the terminal part illustrated in FIG. 6.

As illustrated in FIG. 4A, a coaxial cable 70 includes a core wire 71 and a shield wire 72. The shield wire 72 has a tubular shape. The core wire 71 is disposed inside the shield wire 72. The shield wire 72 includes a braided wire 72A including a plurality of electric wires formed into a mesh shape (see FIG. 4B), for example. The shield wire 72 may include, in addition to the braided wire 72A, a conductor film 72B (see FIG. 4B). A material of the conductor film 72B is aluminum, for example. However, the material is not limited to this. The coaxial cable 70 may include an insulator 73 and an outer coat 74. The insulator 73 is formed into a tubular shape, inside which the core wire 71 is disposed. The shield wire 72 externally surrounds the insulator 73. The outer coat 74 is made of an insulator, and externally covers the shield wire 72. As illustrated in FIG. 7, the shield wire 72 further extends forward over a front end of the outer coat 74. A foremost part 72*a* of the shield wire 72 is exposed (foremost part 72*a* will be hereinafter referred to as "exposed part"). The core wire 71 projects forward over a front end of the shield wire 72 and a front end of the insulator 73. A front end 71*a* of the core wire 71 is exposed from the insulator 73 and the shield wire 72.

Figure 2:
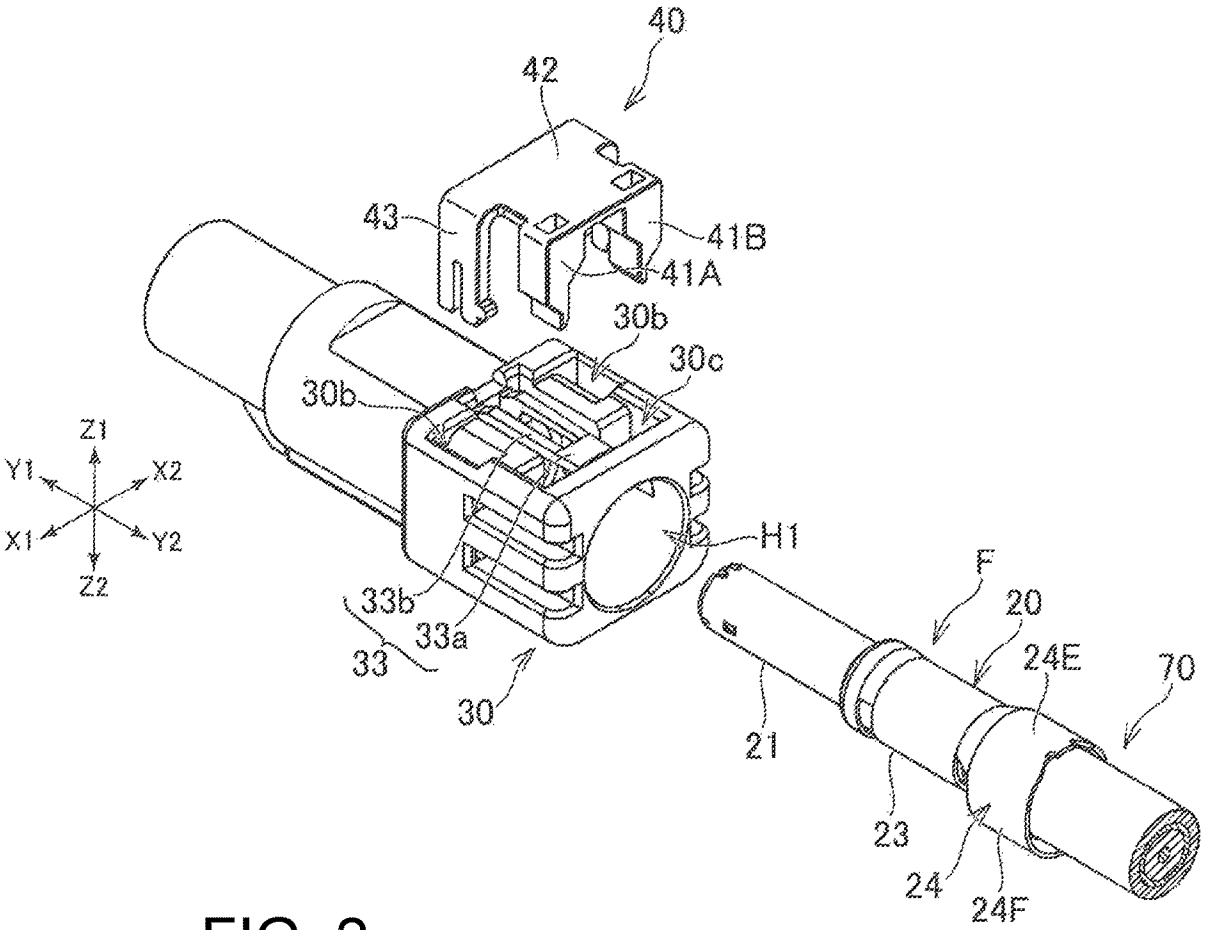
FIG. 2 is an exploded perspective view of the coaxial connector.

As illustrated in FIG. 2, a coaxial connector 1 includes a terminal part F attached to an end part of the coaxial cable 70, and a housing 30. The terminal part F includes, as illustrated in FIG. 7, a center terminal 11 connected to the core wire 71, and a shield terminal 20 connected to the shield wire 72. The terminal part F may include a dielectric body 13 formed into a cylindrical shape. The dielectric body 13 formed into the cylindrical shape may be internally disposed with the center terminal 11. The shield terminal 20 having a cylindrical shape is internally disposed with the center terminal 11 and the dielectric body 13. The housing 30 is formed with an insertion hole H1 passing through the housing 30 in a front-rear direction. The center terminal 11, the dielectric body 13, and the shield terminal 20 are accommodated in the insertion hole H1 (see FIG. 4A). In an example of the coaxial connector 1, the center terminal 11, the dielectric body 13, and the shield terminal 20 may be inserted from a rear side of the insertion hole H1. The coaxial connector 1 may include a secondary locking member 40 attached to the housing 30 to restrict the terminal part F from moving rearward.

As illustrated in FIG. 4A, the center terminal 11 may include, at its rearmost part, a crimped part 11*a* crimped onto the end part 71*a* (part projecting from the insulator 73, see FIG. 7) of the core wire 71. The center terminal 11 may include, at its foremost part, a contact part 11*b* configured to come into contact with a center terminal of a target connector. In the example of the coaxial connector 1, the center terminal 11 is a male terminal. The contact part 11*b* is formed into a pin shape. The center terminal of the target connector is formed into a cylindrical shape. The contact part 11*b* is to be inserted into the center terminal having the cylindrical shape. Different from the example of the coaxial connector 1, the center terminal 11 may be a female terminal. In this case, the contact part 11*b* may be formed into a cylindrical shape, for example.

Figure 6:
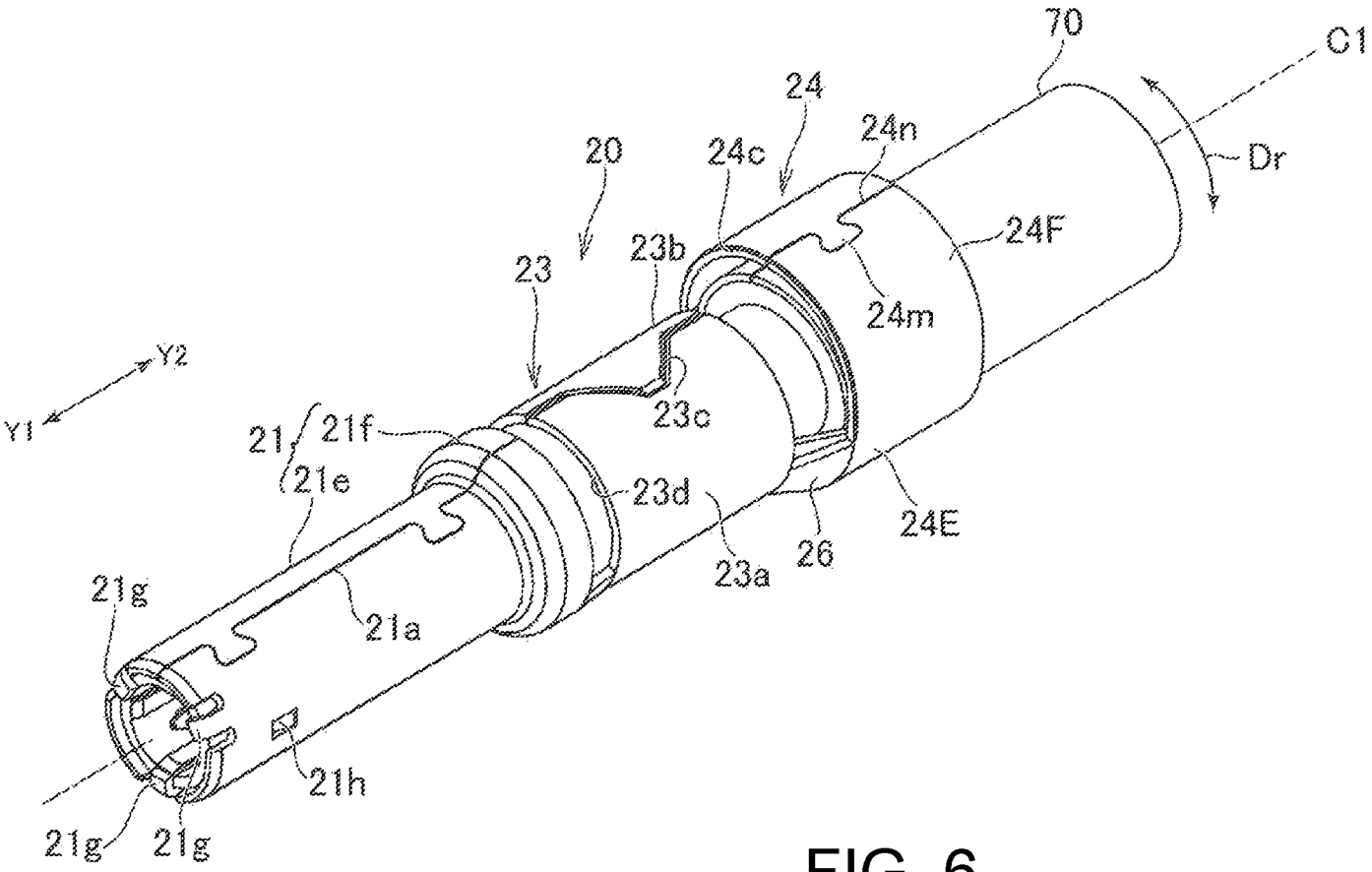
FIG. 6 is a perspective view of a terminal part to be attached to an end part of the coaxial cable.

The shield terminal 20 includes, at its foremost part, a contact part 21 (see FIG. 6). The contact part 21 may have a cylindrical shape to surround the center terminal 11 and the dielectric body 13, as illustrated in FIG. 4A. In other words, the contact part 21 may be formed into the cylindrical shape, and may be internally disposed with the center terminal 11 and the dielectric body 13. The dielectric body 13 may be attached to the contact part 21 so as to prevent the dielectric body 13 and the contact part 21 from moving each other. A fixing structure between the contact part 21 and the dielectric body 13 will be described later in detail.

When the coaxial connector 1 is used, the contact part 21 comes into contact with a terminal of the target connector. As illustrated in FIG. 4A, in the example of the coaxial connector 1, a gap is provided between an inner face of the insertion hole H1 of the housing 30 and the contact part 21. The gap is to be inserted with a shield terminal M of the target connector. The shield terminal M has a cylindrical shape. The shield terminal M may come into contact with an outer face of the contact part 21.

As illustrated in FIG. 4A, the shield wire 72 includes a part 72*e* lying in front of a connecting part 23, described later, (see FIG. 6) (part 72*e* will be hereinafter referred to as "projecting part"). The projecting part 72*e* lies in front of a front edge 23*d* of the connecting part 23. The contact part 21 of the shield terminal 20 includes a main body 21*e* and a rearmost part 21*f* (see FIG. 6). The main body 21*e* has a cylindrical shape to surround the center terminal 11. In other words, the main body 21*e* surrounds the center terminal 11 over a whole circumference in a circumferential direction about a center line C1 of the coaxial cable 70 (The term "center line C1 of the coaxial cable 70" will be hereinafter referred to as "cable center line". The term "circumferential direction about the center line C1" denotes a direction illustrated with Dr in FIG. 6, and will be hereinafter referred to as "cable circumferential direction".). The main body 21*e* lies in front of the shield wire 72. The rearmost part 21*f* may lie behind the main body 21*e* to surround the projecting part 72*e* of the shield wire 72. In other words, the rearmost part 21*f* may also have a cylindrical shape to surround the projecting part 72*e* of the shield wire 72 over a whole circumference in the cable circumferential direction Dr. In a side view of the shield terminal 20 and the coaxial cable 70, the rearmost part 21*f* may overlap with the projecting part 72*e* of the shield wire 72. With this structure of the contact part 21, the core wire 71 and the center terminal 11 are covered by the shield wire 72 or the contact part 21 of the shield terminal 20 at a position in the front-rear direction. As a result, impedance of the terminal part F can be constant. In the example of the coaxial connector 1, the rearmost part 21*f* has a diameter greater than a diameter of the main body 21*e*. Different from the example of the coaxial connector 1, the diameter of the rearmost part 21*f* may be identical to the diameter of the main body 21*e*.

The shield terminal 20 includes the connecting part 23 behind the contact part 21 (see FIG. 6). Only a part of a front edge of the connecting part 23 is connected to a rear edge of the contact part 21 (rear edge of the rearmost part 21*f*). The connecting part 23 also has a cylindrical shape. As illustrated in FIG. 4A, the connecting part 23 surrounds the exposed part 72*a* (part exposed from the outer coat 74, see FIG. 7) of the shield wire 72, and is connected to the shield wire 72. The connecting part 23 may have two curved parts 23*a* and 23*b*. The curved parts 23*a* and 23*b* may be bent to surround the shield wire 72 so as to be press fitted to the shield wire 72.

Figure 4B:
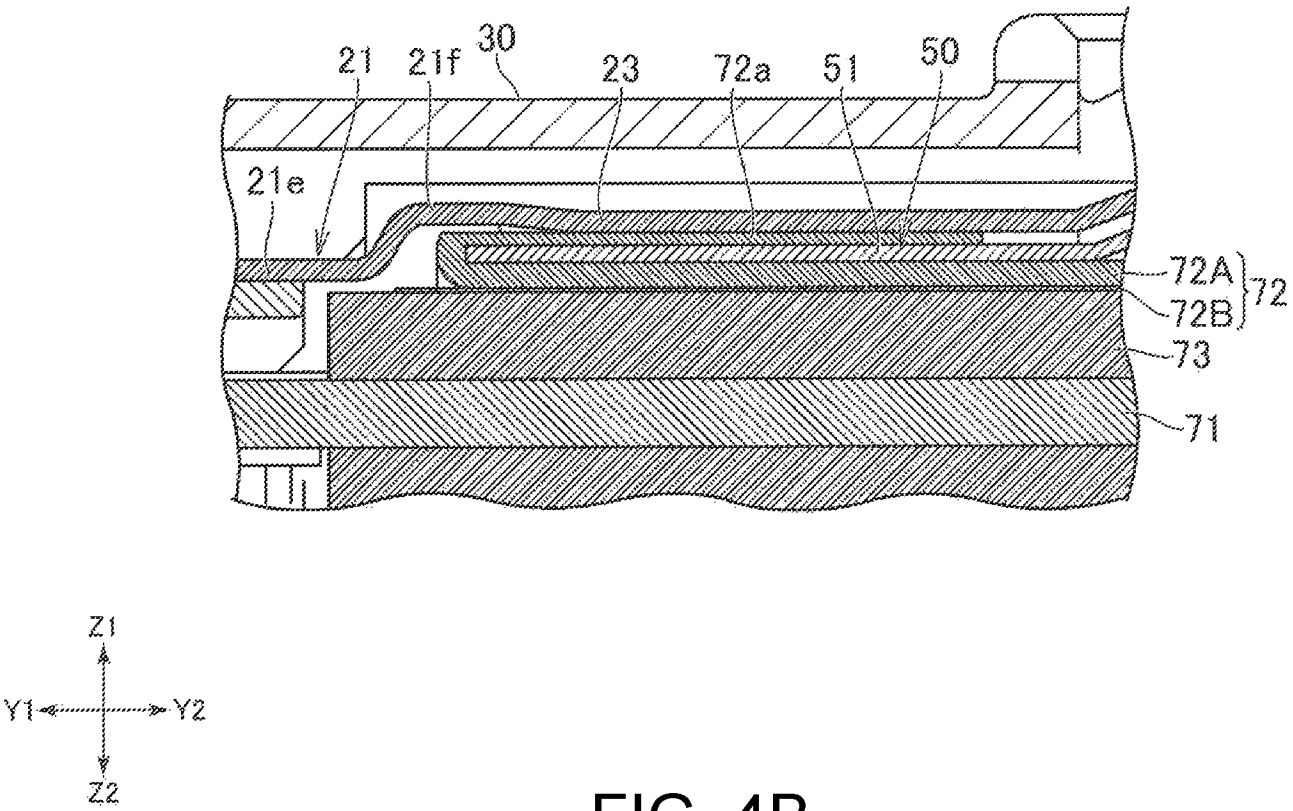
FIG. 4B is an enlarged view of FIG. 4A.

As illustrated in FIG. 7, the coaxial connector 1 may include a supporting member 50 having a cylindrical shape. The supporting member 50 includes a shield wire holding part 51 configured to hold the shield wire 72. As illustrated in FIG. 4B, the shield wire holding part 51 may lie inside the connecting part 23 of the shield terminal 20. With this structure, a force applied from the connecting part 23 to the insulator 73 of the coaxial cable 70 can be mitigated by the shield wire holding part 51. As a result, a difference in impedance due to a deformation in the insulator 73 can be reduced. The supporting member 50 may be stiffer than the shield wire 72. The supporting member 50 is made of metal, for example.

As illustrated in FIG. 4B, a foremost part (exposed part 72*a*) of the shield wire 72 of the coaxial cable 70 is folded outward of the shield wire holding part 51. More specifically, an end part of the braided wire 72A constituting the shield wire 72 is folded outward of the shield wire holding part 51. The exposed part 72*a* of the shield wire 72 lies inside the connecting part 23 of the shield terminal 20. The shield wire holding part 51 lies inside the exposed part 72*a* of the shield wire 72. With this structure, a holding force of the connecting part 23 directly acts onto the exposed part 72*a* of the shield wire 72, securing stability of electrical connection.

As will be described later, the supporting member 50 may include an outer coat holding part 52 (see FIG. 7) lying behind the shield wire holding part 51. The supporting member 50 may include an intermediate part 53 (see FIG. 7) connecting a part of a front edge of the outer coat holding part 52 and a part of a rear edge of the shield wire holding part 51. The supporting member 50 is made of a metallic plate material, for example. The plate material is bent to externally surround the shield wire 72 to constitute the shield wire holding part 51, as well as is bent to externally surround the outer coat 74 to constitute the outer coat holding part 52.

As illustrated in FIG. 6, the shield terminal 20 may include a catching-target part 24 formed into a cylindrical shape to surround the coaxial cable 70. The catching-target part 24 may lie behind the connecting part 23. More specifically, the catching-target part 24 may lie at a rearmost part of the shield terminal 20. The shield terminal 20 may include an intermediate part 26 lying between the catching-target part 24 and the connecting part 23. Only a part of a front edge of the catching-target part 24 may be connected to a rear edge of the connecting part 23 via the intermediate part 26. As will be described later in detail, the catching-target part 24 is used to fix in position the shield terminal 20 in the housing 30 in the front-rear direction.

The shield terminal 20 is bent and formed to surround the cable center line C1. The contact part 21, the connecting part 23, and the catching-target part 24 are formed integrally. More specifically, the shield terminal 20 may be formed by bending a single metallic plate material including the contact part 21, the connecting part 23, and the catching-target part 24 to surround the cable center line C1. The shield terminal 20, described above, may be formed through press working. Therefore, the shield terminal 20 can be formed easier at a lower cost, compared with a conventional shield terminal formed through casting and cutting.

As illustrated in FIG. 6, the contact part 21 has a boundary 21*a*. Two edges of the plate material join each other at the boundary 21*a*. In the example of the coaxial connector 1, engagement projection parts 21*m* are formed on one of the edges, while recess parts are formed on the other of the edges. Upon the engagement projection parts 21*m* fit to the recess parts, the two edges join each other. The connecting part 23 also has a boundary 23*c* between the two curved parts 23*a* and 23*b*. The catching-target part 24 has a boundary 24*n*. The two edges of the plate material join each other at the boundary 24*n*. In the example of the coaxial connector 1, an engagement projection part 24*m* is formed on one of the edges, while a recess part is formed on the other of the edges. Upon the engagement projection part 24*m* fits to the recess part, the two edges join each other. The shape of the catching-target part 24 is not limited to the shape illustrated in the example of the coaxial connector 1. In other words, the two edges of the plate material may be away from each other at the boundary 24*n*.

Figure 5:
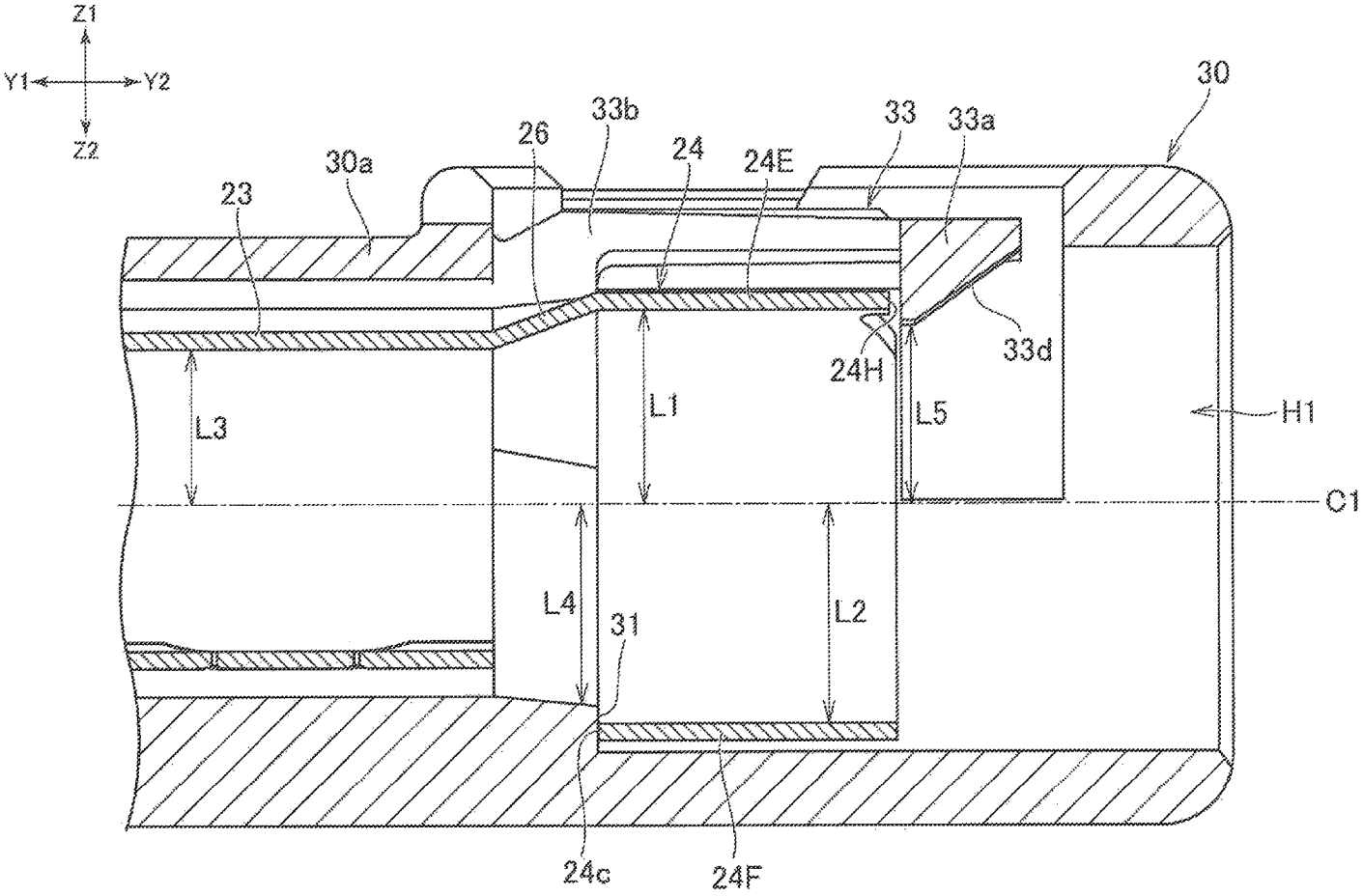
FIG. 5 is a cross-sectional view of a housing and a shield terminal. Its cut section is identical to FIG. 4A.

As illustrated in FIG. 5, the housing 30 may include a catching face 31 inside the insertion hole H1. The catching face 31 is formed on the inner face of the insertion hole H1, and faces rearward. A part of a front edge 24*c* (front edge of a second curved part 24F, described later) of the catching-target part 24 of the shield terminal 20 is in contact with the catching face 31. Therefore, the shield terminal 20 is restricted from moving forward. With this structure, the shape of the shield terminal can be simplified, compared with a conventional engaging structure in which two annular parts are provided on a circumference surface of a shield terminal to allow a locking member to engage with the two annular parts. In the example of the coaxial connector 1, in the insertion hole H1, an inner diameter at a part accommodating the connecting part 23 is smaller than an inner diameter at a part accommodating the catching-target part 24. A step formed between the two parts functions as the catching face 31.

Figure 10:
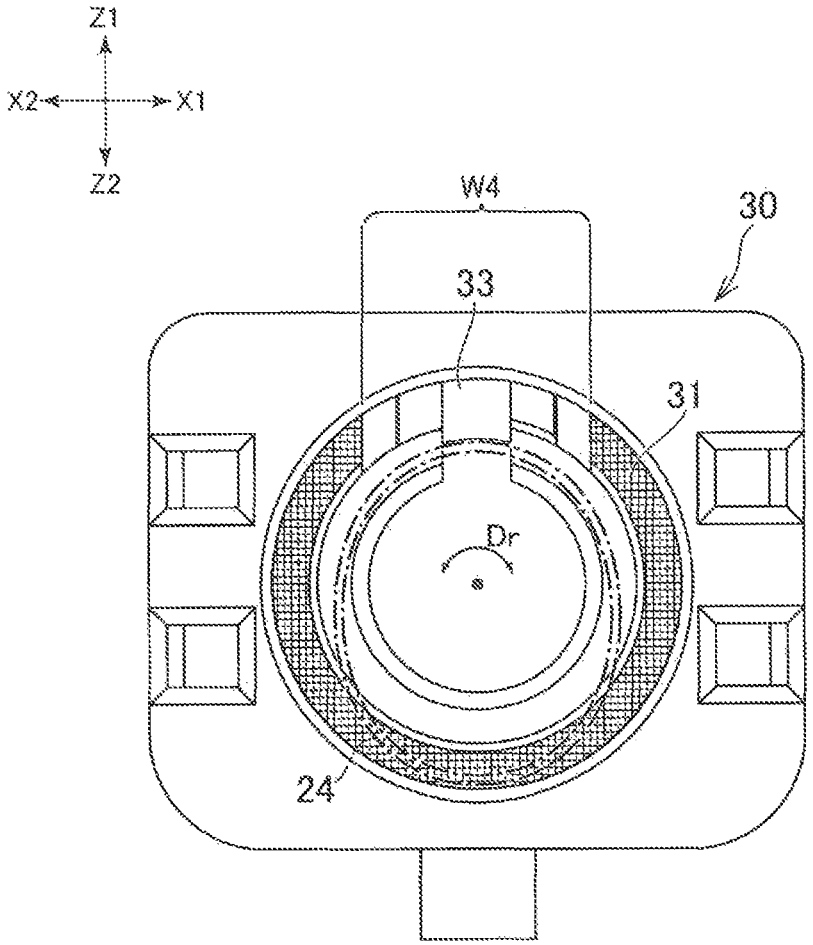
FIG. 10 is a rear view of the housing.

In the example of the coaxial connector 1, the catching face 31 and the catching-target part 24 are allowed to relatively rotate about the cable center line C1. The terminal part F can thus rotate about the cable center line C1. As illustrated in FIG. 10, the catching face 31 may surround the cable center line C1, in a rear view of the housing 30 (in FIG. 10, the catching face 31 is shaded). In other words, the catching face 31 may be annular about the cable center line C1, in the rear view of the housing 30. Therefore, while the part of the front edge 24*c* of the catching-target part 24 is in contact with the catching face 31, the shield terminal 20 is allowed to rotate (i.e., the terminal part F and the coaxial cable 70 are allowed to rotate) about the cable center line C1. As the coaxial cable 70 rotates, a position on the catching face 31, with which the catching-target part 24 is in contact, changes in the cable circumferential direction (direction illustrated with Dr in FIG. 10). In the example of the coaxial connector 1, the coaxial cable 70 and the terminal part F can rotate 360 degrees about the cable center line C1.

The catching face 31 may not be formed in a partial region in the cable circumferential direction. As illustrated in FIG. 10, in the example of the coaxial connector 1, the catching face 31 is not formed in a partial region W4 in the cable circumferential direction. In the housing 30, a primary locking part 33 (see FIG. 2) configured to restrict the shield terminal 20 from moving rearward is formed. The primary locking part 33 lies in the region W4. As will be described later in detail, the catching-target part 24 includes, at a part in the cable circumferential direction, the second curved part 24F (see FIG. 11) configured to come into contact with the catching face 31. A width of the second curved part 24F in the cable circumferential direction is greater than a width of the region W4. Therefore, when both the coaxial cable 70 and the terminal part F lie at respective rotation positions in the cable circumferential direction, the part or whole of the front edge 24*c* of the second curved part 24F is in contact with the catching face 31. In other words, even if the front edge 24*c* of the second curved part 24F lies in the region W4, the part of the front edge 24*c* of the second curved part 24F is in contact with the catching face 31. As a result, the shield terminal 20 is restricted from moving forward. Different from the example of the coaxial connector 1, the second curved part 24F may extend in a whole area in the circumferential direction about the cable center line C1.

Figure 11:
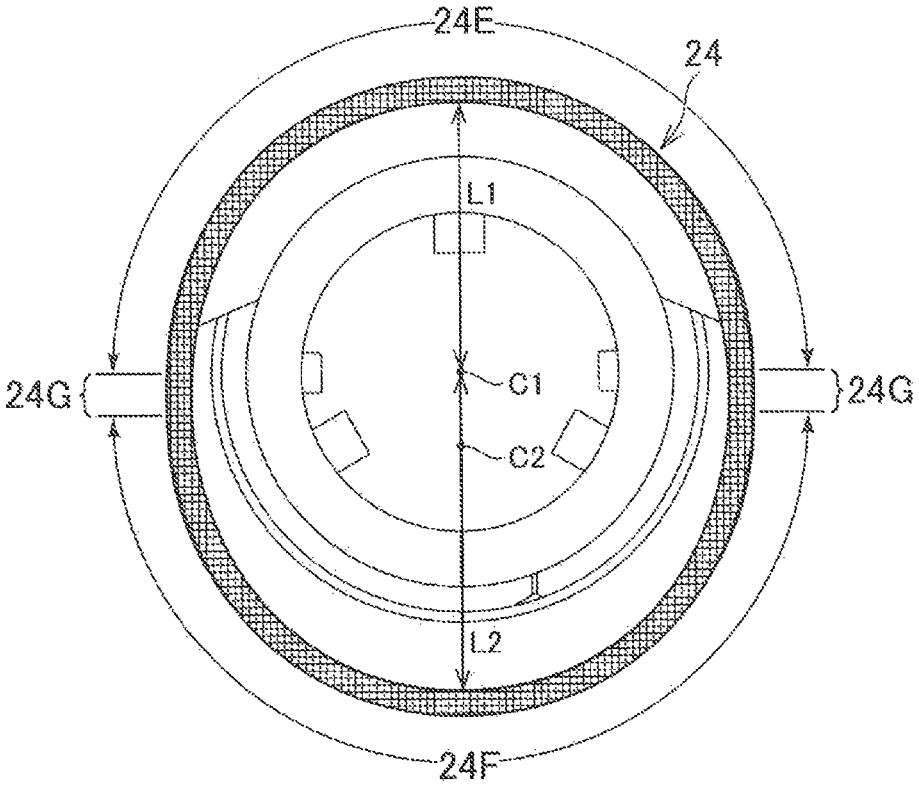
FIG. 11 is a rear view of the shield terminal.

As illustrated in FIG. 11, the catching-target part 24 includes a first curved part 24E at a part in the circumferential direction about the cable center line C1. The catching-target part 24 further includes the second curved part 24F at another part in the circumferential direction. The first curved part 24E and the second curved part 24F are each curved to surround the coaxial cable 70. The catching-target part 24 may have the cylindrical shape as a whole.

The first curved part 24E is connected to another part of the shield terminal 20 (i.e., part in front of or behind the catching-target part 24). On the other hand, the second curved part 24F is not connected to another part of the shield terminal 20. As illustrated in FIGS. 2 and 6, in the example of the coaxial connector 1, the catching-target part 24 may lie behind the connecting part 23. The first curved part 24E may be connected to the connecting part 23. The front edge 24*c* (see FIG. 6) of the second curved part 24F is not connected to the connecting part 23.

As illustrated in FIG. 5, the shield terminal 20 may include the intermediate part 26 between the front edge of the first curved part 24E and the rear edge of the connecting part 23 for connection to each other. A diameter (distance L1 (see FIG. 5) from the cable center line C1) of the first curved part 24E is greater than a diameter of the connecting part 23 (distance L3 (see FIG. 5) from the cable center line C1). Therefore, the intermediate part 26 extends forward from the first curved part 24E, and inclines toward the cable center line C1. The relationship between the size of the connecting part 23 and the size of the first curved part 24E is not limited to the relationship illustrated in the example of the coaxial connector 1. For example, the diameter of the first curved part 24E may be identical to the diameter of the connecting part 23.

As illustrated in FIG. 5, a distance L2 from the cable center line C1 to the second curved part 24F is longer than the distance L1 from the cable center line C1 to the first curved part 24E. The catching face 31 formed on the inner face of the insertion hole H1 of the housing 30 is in contact with the front edge 24*c* of the second curved part 24F. On the other hand, the first curved part 24E and the intermediate part 26 do not come into contact with the catching face 31. In other words, a distance L4 from the cable center line C1 to the catching face 31 is shorter than the distance L2 from the cable center line C1 to the second curved part 24F, but longer than the distance L1 from the cable center line C1 to the first curved part 24E. Therefore, the front edge 24*c* of the second curved part 24F is in contact with the catching face 31, while the first curved part 24E and the intermediate part 26 do not come into contact with the catching face 31. While the front edge 24*c* of the second curved part 24F is in contact with the catching face 31, the coaxial cable 70 and the terminal part F are rotatable over 360 degrees about the cable center line C1.

The shield terminal 20 may be rotatably supported by an inner face of the housing 30. In the example of the coaxial connector 1, as illustrated in FIG. 4A, a supporting part 34 surrounding the contact part 21 of the shield terminal 20 is provided on the inner face of the housing 30. An inner face of the supporting part 34 is curved along a circumference surface (more specifically, a circumference surface of a rear part of the main body 21*e*) of the contact part 21. The shield terminal 20 is rotatably supported by the supporting part 34.

As illustrated in FIG. 11, in the example of the coaxial connector 1, the first curved part 24E may be an arc about the cable center line C1. The first curved part 24E may be formed over 180 degrees about the cable center line C1. The second curved part 24F may be an arc about a point C2 lying away from the cable center line C1 in a radial direction of the coaxial cable 70 (The term "radial direction of the coaxial cable 70" will be hereinafter referred to as "cable radial direction"). The second curved part 24F may be formed over 180 degrees about the point C2. The catching-target part 24 may include flat parts 24G each coupling the first curved part 24E and the second curved part 24F.

The shape of the catching-target part 24 is not limited to the shape illustrated in the example of the coaxial connector 1. For example, a distance from the cable center line C1 to the catching-target part 24 may be constant in a whole area in the circumferential direction about the cable center line C1. In other words, the distance L1 from the cable center line C1 to the first curved part 24E may be identical to the distance L2 from the cable center line C1 to the second curved part 24F. In this case, the intermediate part 26 connected to the first curved part 24E may be formed so as not to come into contact with the catching face 31 of the housing 30. In another example, the first curved part 24E may be curved about a point that is away from the cable center line C1. The shield terminal 20 may not include the flat parts 24G.

The housing 30 includes the primary locking part 33 (see FIG. 2). As illustrated in FIG. 5, the primary locking part 33 includes a catching part 33*a*. The catching part 33*a* is configured to come into contact with a rear edge 24*h* of the catching-target part 24 of the shield terminal 20 to restrict the shield terminal 20 from moving rearward. A distance L5 from the cable center line C1 to the catching part 33 is shorter than the respective distances L1 and L2 from the cable center line C1 to the curved parts 24E and 24F. Therefore, as the shield terminal 20 rotates about the cable center line C1, the catching part 33*a* comes into contact, at any positions, with the rear edge 24*h* of the catching-target part 24. Regardless of an angle (position in the cable circumferential direction) of the shield terminal 20 when the shield terminal 20 is inserted into the housing 30 in a production process of the coaxial connector 1, the primary locking part 33 can catch the catching-target part 24, restricting the shield terminal 20 from moving rearward.

As illustrated in FIG. 5, in the example of the coaxial connector 1, the primary locking part 33 includes a spring part 33*b* above the catching-target part 24. A base part 33*c* of the spring part 33*b* is connected, in the housing 30, to a part 30*a* covering the connecting part 23 of the shield terminal 20. The spring part 33*b* extends rearward from the base part 33*c*, and is formed with the catching part 33*a* at its rear end. The catching part 33*a* includes, on its rear side, a guide face 33*d* diagonally extending rearward and upward. When the shield terminal 20 is inserted into the housing 30 in the production process of the coaxial connector 1, the catching-target part 24 comes into contact with the guide face 33*d*, causing the spring part 33*b* to elastically deform upward. Upon the front edge 24*c* of the catching-target part 24 is inserted fully to come into contact with the catching face 31 of the housing 30, the spring part 33*b* returns to its initial position. The catching part 33*a* thus catches the rear edge 24*h* of the catching-target part 24.

As illustrated in FIG. 2, the coaxial connector 1 may include the secondary locking member 40 attached to the housing 30. In the example of the coaxial connector 1, the secondary locking member 40 is attached to an upper side of the housing 30. In the example of the coaxial connector 1, the secondary locking member 40 may include a cover part 42. The cover part 42 may cover the spring part 33*b* of the primary locking part 33 to restrict the spring part 33*b* from elastically deforming upward (see FIG. 4C). The position of the secondary locking member 40 is not limited to the position illustrated in the example of the coaxial connector 1. For example, the secondary locking member 40 may be attached to a lower side of the housing 30. The secondary locking member 40 may be attached to a right side or a left side of the housing 30. The secondary locking member 40 may include attaching parts 43 respectively extending downward from a right side and a left side of the cover part 42. The attaching parts 43 are inserted into an attaching hole 30*b* formed on the housing 30, and thus is attached to the housing 30.

Figure 3:
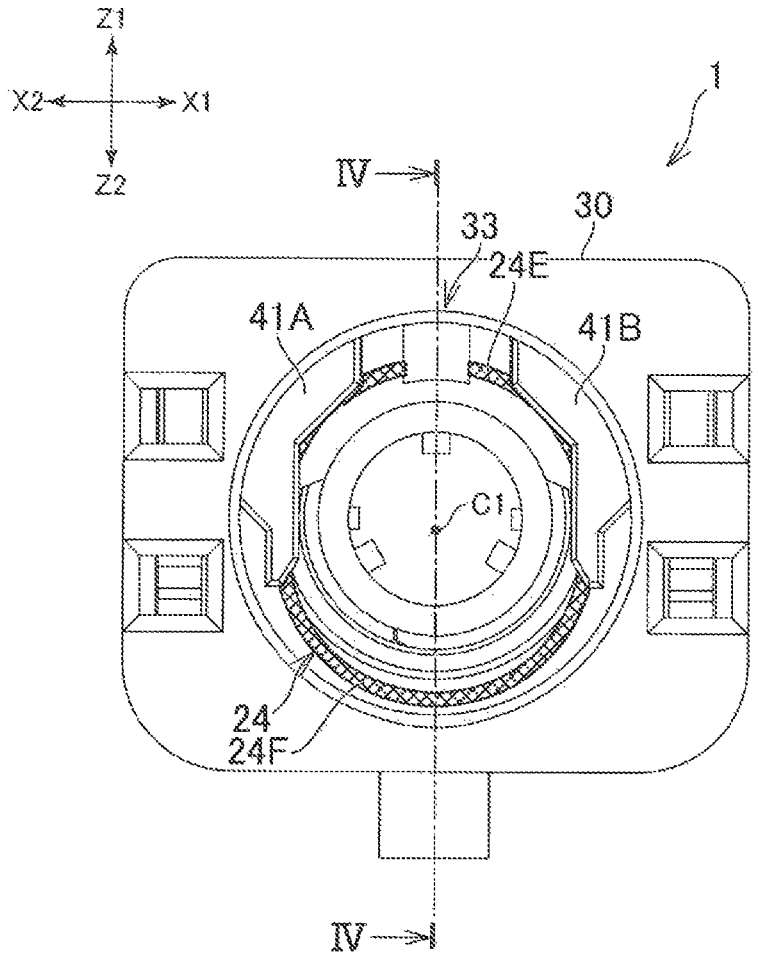
FIG. 3 is a rear view of the coaxial connector.
Figure 8:
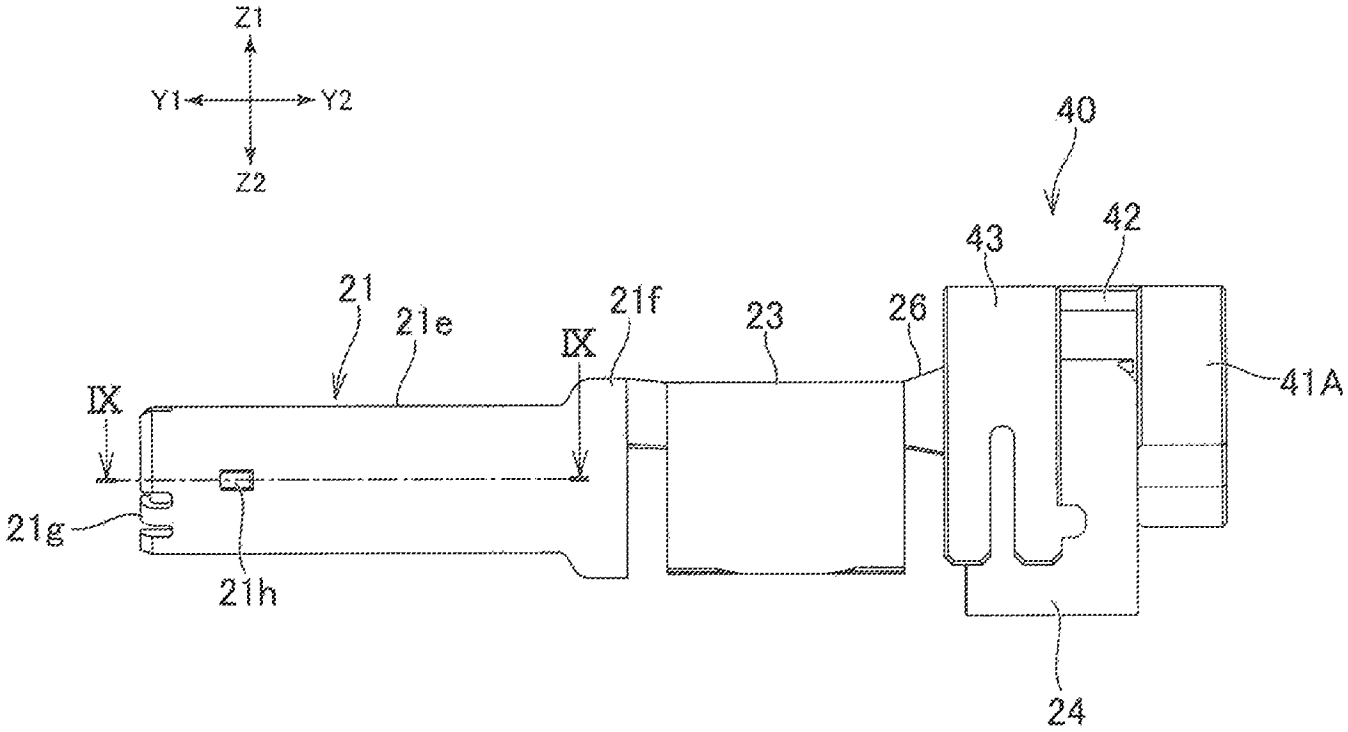
FIG. 8 is a side view of the shield terminal and a secondary locking member.
Figure 12:
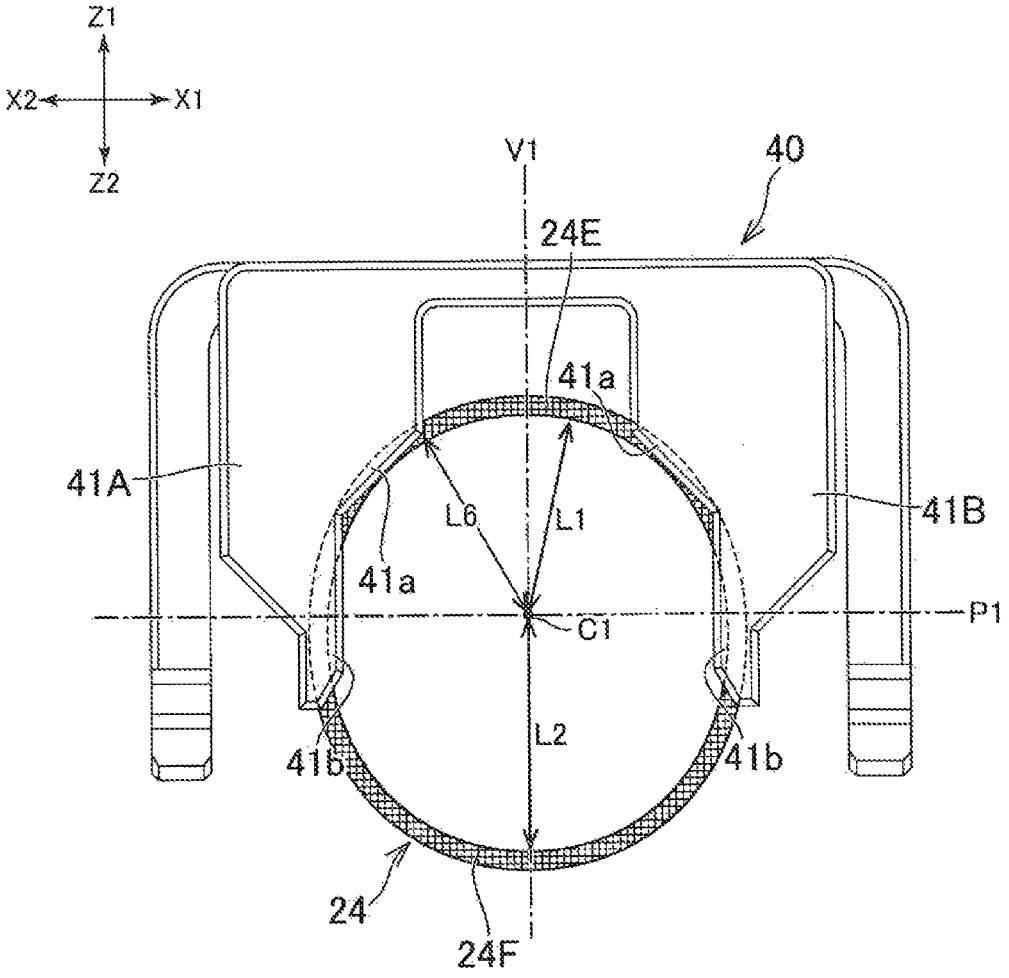
FIG. 12 is a rear view illustrating a positional relationship between the secondary locking member and a catching-target part of the shield terminal.

As illustrated in FIG. 2, the secondary locking member 40 includes catching parts 41A and 41B. While the secondary locking member 40 is attached to the housing 30, the catching parts 41A and 41B lie behind the rear edge 24*h* of the catching-target part 24 of the shield terminal 20 to restrict the shield terminal 20 from moving rearward (see FIG. 8). As illustrated in FIG. 12, the catching parts 41A and 41B extend downward from the cover part 42. In the example of the coaxial connector 1, the secondary locking member 40 includes the two catching parts 41A and 41B being separated from each other in the cable circumferential direction. The two catching parts 41A and 41B may be symmetrical relative to a vertical line V1 passing through the cable center line C1. The primary locking part 33 may lie between the two catching parts 41A and 41B (see FIG. 3). The catching parts 41A and 41B are inserted into a hole 30*c* (see FIG. 2) formed on the housing 30 to lie behind the catching-target part 24.

As illustrated in FIG. 12, each of the catching parts 41A and 41B may include a first inside part 41*a* and a second inside part 41*b* both lying behind the catching-target part 24. The inside parts 41*a* and 41*b* are parts lying adjacent to the cable center line C1 on each of the catching parts 41A and 41B. The second inside parts 41*b* respectively lie below the first inside parts 41*a*. A distance L6 from the cable center line C1 to the first inside part 41*a* is shorter than the respective distances L1 and L2 from the cable center line C1 to the curved parts 24E and 24F. A distance L7 from the cable center line C1 to the second inside part 41*b* is also shorter than the respective distances L1 and L2 from the cable center line C1 to the curved parts 24E and 24F.

Figure 13:
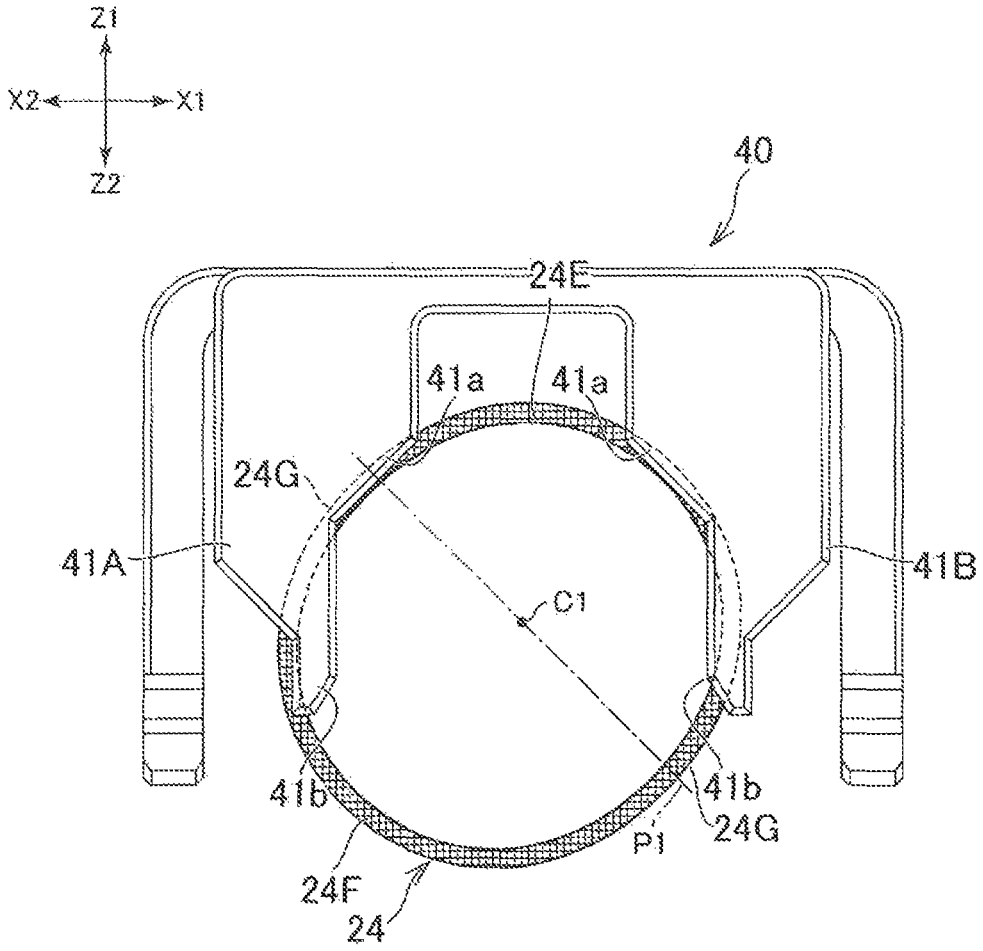
FIG. 13 is a rear view illustrating a positional relationship between the secondary locking member and the catching-target part of the shield terminal. The view illustrates when the shield terminal is rotated.

With this structure, when the shield terminal 20 rotates 360 degrees about the cable center line C1, the inside parts 41*a* and 41*b* come into contact, at any positions, with the rear edge 24*h* of the catching-target part 24. For example, in the state illustrated in FIG. 12, the first inside parts 41*a* lie behind the first curved part 24E, while the second inside parts 41*b* lie behind the flat parts 24G (see FIG. 11). FIG. 13 is a view illustrating a positional relationship between the catching-target part 24 and the catching parts 41A and 41B when the shield terminal 20 rotates 45 degrees only. In the state illustrated in FIG. 13, the inside parts 41*a* and 41*b* of the catching part 41B on the right side lie behind the first curved part 24E. The inside parts 41*a* and 41*b* of the catching part 41A on the left side respectively lie behind the flat parts 24G and the second curved part 24F. Even when the shield terminal 20 further rotates, the inside parts 41*a* and 41*b* come into contact, at any positions, with the rear edge 24*h* of the catching-target part 24.

As illustrated in FIG. 12, the second inside part 41*b* of the catching part 41A on the right side and the second inside part 41*b* of the catching part 41B on the left side both extend downward over a horizontal face P1 passing through the cable center line C1. The second inside parts 41*b* of the catching parts 41A and 41B face each other via the cable center line C1. With this structure, the secondary locking member 40 can effectively restrict the shield terminal 20 from moving rearward.

As described above, the catching-target part 24 lies behind the connecting part 23. More specifically, the catching-target part 24 lies at the rearmost part of the shield terminal 20. Therefore, no other part of the shield terminal 20 is connected to the rear edge 24*h* of the catching-target part 24. With this configuration, the catching parts 41A and 41B can come into contact, at a position on a wider area, with the rear edge 24*h* of the catching-target part 24. In other words, when another portion of the shield terminal 20 is connected to the rear edge 24*h* of the catching-target part 24, a structure configured to avoid the portion and the catching parts 41A and 41B of the secondary locking member 40 from coming into contact with each other is required. In the example of the coaxial connector 1, the catching-target part 24 lies on the rearmost part of the shield terminal 20, making such an interference avoidance structure unnecessary.

Figure 4C:
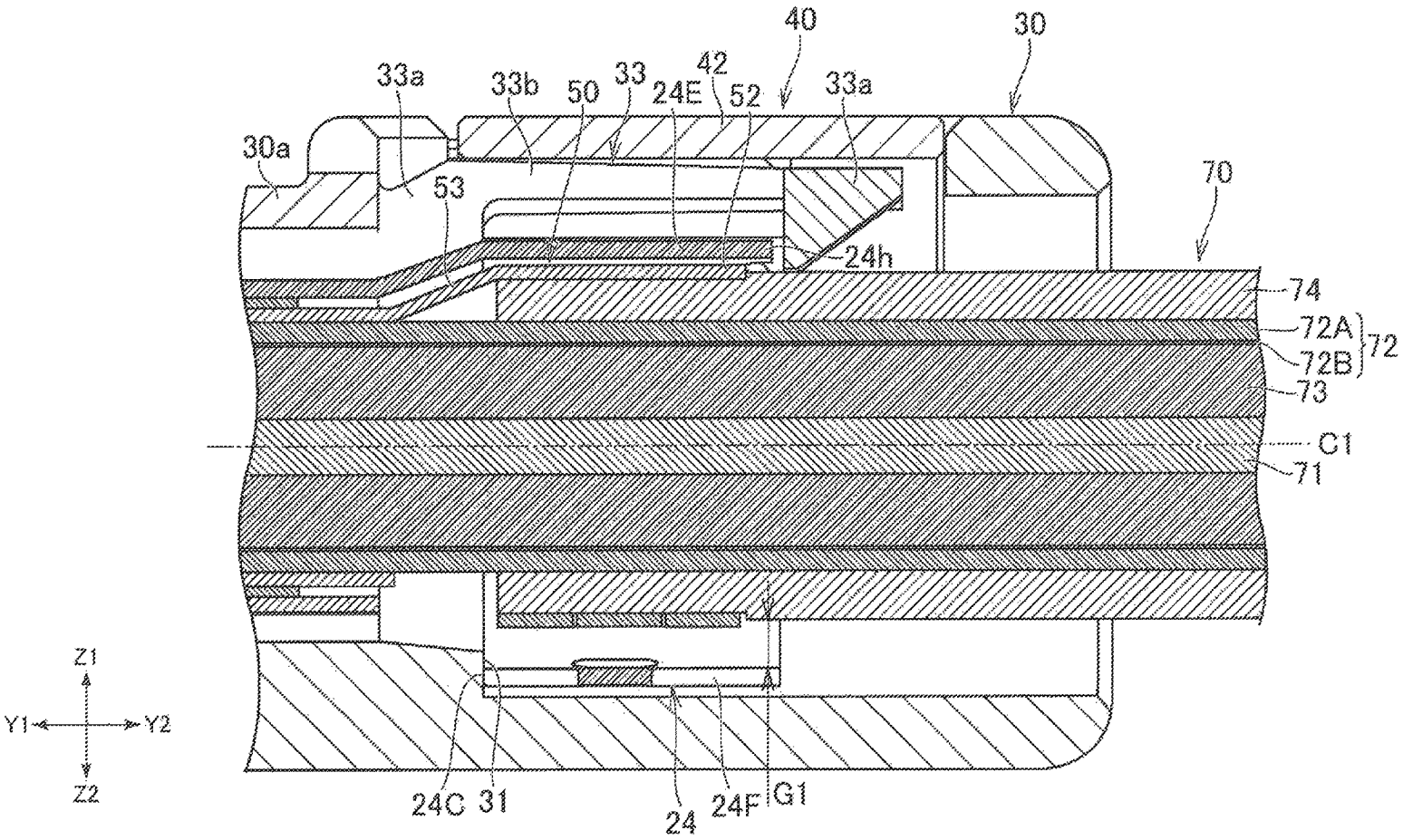
FIG. 4C is an enlarged view of FIG. 4A.

As illustrated in FIG. 4C, the shield wire 72 extends forward over the front edge 24*c* of the catching-target part 24. The shield wire 72 lies inside the catching-target part 24. With this configuration, effects of the catching-target part 24 to impedance in the coaxial cable 70 can be mitigated. As a result, a shape appropriate for stable engagement with the catching face 31, the primary locking part 33, and the secondary locking member 40 of the housing 30 can be selected as a shape of the catching-target part 24. In the example of the coaxial connector 1, the distance L2 (see FIG. 5) from the cable center line C1 to the second curved part 24F is longer than the distance L1 (see FIG. 5) from the cable center line C1 to the first curved part 24E. However, the shield wire 72 lies inside the catching-target part 24, mitigating effects of the catching-target part 24 to impedance. In the example of the coaxial connector 1, the shield wire 72 is also present inside the connecting part 23 and the intermediate part 26 of the shield terminal 20, further mitigating effects of the connecting part 23 and the intermediate part 26 to impedance.

The structure in which the shield terminal 20 is fixed in the housing 30, i.e., the catching-target part 24 is disposed behind the connecting part 23, prevents electric characteristics of the connector 1 from being sacrificed. For example, when an annular projection part projecting outward of the shield terminal 20 and surrounding the cable center line is formed on the contact part 21 through press working, the press working might cause a recess to occur inside the annular projection part. The shield wire 72 is not present inside the contact part 21, leading to a difference in impedance between a position at which the recess is present and another position. In other words, electric characteristics are sacrificed. On the other hand, in the example of the shield terminal 20, the catching-target part 24 lies behind the connecting part 23, making an inner diameter of the contact part 21 substantially constant over an area from a front end to a rear end of the contact part 21. As a result, electric characteristics can be prevented from being sacrificed.

The shapes of the catching parts 41A and 41B are not limited to the shapes illustrated in the example of the coaxial connector 1. For example, the catching parts 41A and 41B may not respectively include the first inside parts 41*a*. In other words, the distance L6 from the cable center line C1 to the first inside part 41*a* may be longer than the respective distances L1 and L2 from the cable center line C1 to the curved parts 24E and 24F.

In still another example, the catching-target part 24 may not lie on the rearmost part of the shield terminal 20. For example, another portion may be connected to a rear side of the catching-target part 24, and the catching-target part 24 may lie in front of the connecting part 23.

As described above, the catching-target part 24 of the shield terminal 20 is formed into the cylindrical shape to surround the coaxial cable 70. The catching-target part 24 may be away from an outer face (outer face of the outer coat 74) of the coaxial cable 70. As illustrated in FIG. 4C, in the example of the coaxial connector 1, a gap G1 is formed between the catching-target part 24 and the outer face of the coaxial cable 70. Therefore, the catching parts 41A and 41B of the secondary locking member 40 can further securely come into contact with the rear edge 24*h* of the catching-target part 24. In the example of the coaxial connector 1, the gap G1 is formed between the second curved part 24F of the catching-target part 24 and the outer face of the coaxial cable 70. A gap may further be formed between the first curved part 24E and the outer face of the coaxial cable 70. In the gap G1, a filling member may be disposed.

As described above, the coaxial connector 1 includes the supporting member 50 having the cylindrical shape. The supporting member 50 includes the shield wire holding part 51, and the outer coat holding part 52 lying behind the shield wire holding part 51 (see FIG. 7). As illustrated in FIG. 4C, the outer coat holding part 52 surrounds the outer coat 74 of the coaxial cable 70 to hold the outer coat 74. The outer coat holding part 52 lies inside the catching-target part 24 of the shield terminal 20. Therefore, a movement of the coaxial cable 70 in the cable radial direction relative to the catching-target part 24 can be reduced. As a result, the catching parts 41A and 41B of the secondary locking member 40 can further securely come into contact with the rear edge 24*h* of the catching-target part 24. In the example of the coaxial connector 1, the catching-target part 24 is away from the outer coat holding part 52 in the cable radial direction. A gap is provided between the catching-target part 24 and the outer coat holding part 52. A gap may further be provided between the first curved part 24E of the catching-target part 24 and the outer coat holding part 52.

The fixing structure between the contact part 21 of the shield terminal 20 and the dielectric body 13 will now be described. As illustrated in FIG. 6, the contact part 21 includes, at its front edge, catching parts 21*g* projecting toward the cable center line C1. In the example of the coaxial connector 1, the front edge of the contact part 21 is formed with a plurality of catching parts 21*g* (more specifically, three catching parts 21*g*) separated from each other at intervals in the cable circumferential direction Dr. The front end of the dielectric body 13 is in contact with the catching parts 21*g*, restricting the dielectric body 13 from moving forward relative to the shield terminal 20.

Figure 9:
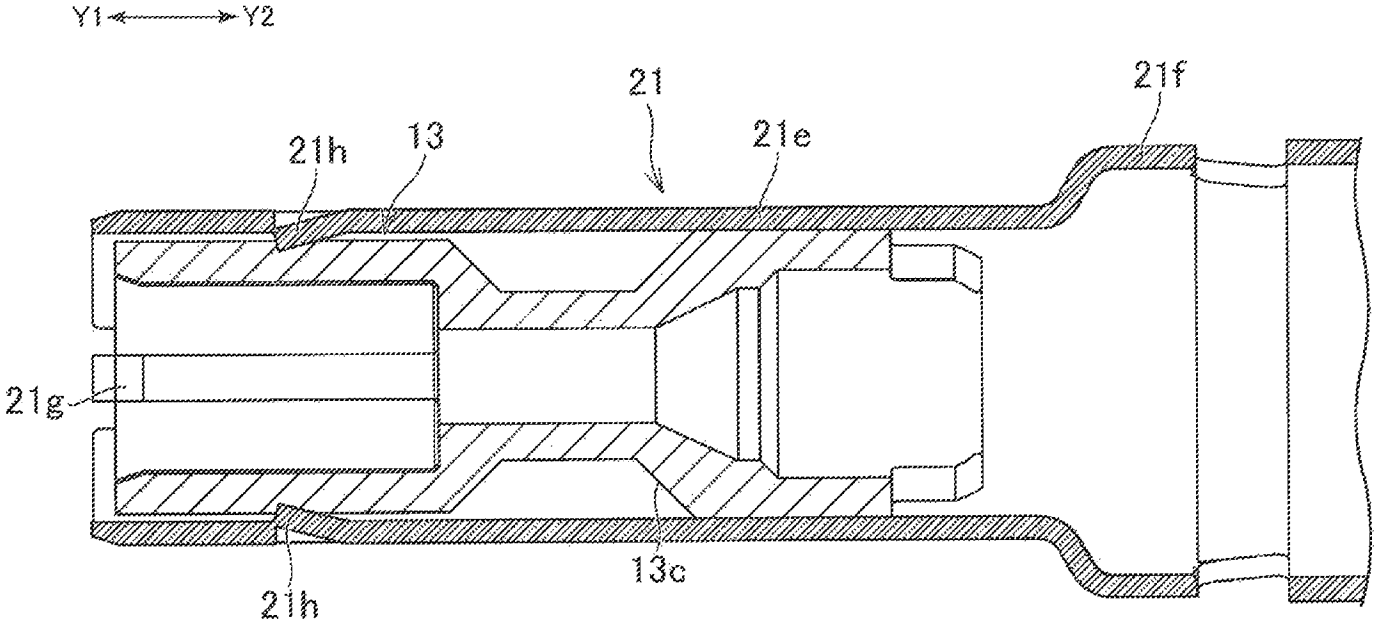
FIG. 9 is a cross-sectional view taken along line IX-IX in FIG. 8.

As illustrated in FIG. 9, the contact part 21 includes, at a position behind the front edge of the contact part 21, engaging parts 21*h* configured to engage with a circumference surface 13*c* of the dielectric body 13. Rear ends of the engaging parts 21*h* are connected to other parts of the contact part 21. Front ends of the engaging parts 21*h* are slightly bent inward toward the cable center line C1. The front ends of the engaging parts 21*h* are engaging with the circumference surface 13*c* of the dielectric body 13, restricting the dielectric body 13 from moving rearward relative to the shield terminal 20. In the example of the coaxial connector 1, two engaging parts 21*h* are formed on the contact part 21 so as to face each other via the cable center line C1.

As described above, the shield terminal 20 includes the contact part 21 surrounding the center terminal 11 and the dielectric body 13 and configured to come into contact with the terminal M of the target connector, the connecting part 23 surrounding the shield wire 72 and connected to the shield wire 72, and the catching-target part 24 surrounding the coaxial cable 70. The contact part 21, the connecting part 23, and the catching-target part 24 are bent and formed integrally into the cylindrical shape to surround the center line C1 of the coaxial cable 70. The housing 30 includes, inside the insertion hole H1, the catching face 31 configured to come into contact with the part of the front edge 24*c* of the catching-target part 24 to restrict the shield terminal 20 from moving forward. With this configuration, a production cost for the coaxial connector 1 can be reduced.

The present disclosure is not limited to the above described embodiments, but may be variously modified. In the example of the coaxial connector 1, the catching-target part 24 includes the first curved part 24E and the second curved part 24F. The distance from the cable center line C1 to the second curved part 24F is greater than the distance from the cable center line C1 to the first curved part 24E. Different from the example of the coaxial connector 1, in a rear view of the coaxial connector 1, the curved parts may be perfect circles. In still another example, the catching-target part 24 may be formed between the contact part 21 and the connecting part 23.

The invention claimed is:

1. A coaxial connector comprising:

a center terminal which is configured to be connected to a core wire of a coaxial cable;

a shield terminal which is configured to be connected to a shield wire of the coaxial cable;

a dielectric body externally surrounding the center terminal, the dielectric body being disposed between the center terminal and the shield terminal; and a housing formed with an insertion hole passing through in a front-rear direction to accommodate the center terminal, the dielectric body, and the shield terminal, the center terminal, the dielectric body, and the shield terminal configured to be inserted into the housing from a rear side of the insertion hole, wherein the shield terminal includes:

a contact part surrounding the center terminal and the dielectric body, the contact part being configured to come into contact with a terminal of a target connector;

a connecting part configured to surround the shield wire of the coaxial cable, the connecting part configured to be connected to the shield wire of the coaxial cable; and a catching-target part configured to surround the coaxial cable, wherein the contact part, the connecting part, and the catching-target part are bent and formed integrally into a cylindrical shape so as to be configured to surround a center line of the coaxial cable, and wherein the housing includes, inside the insertion hole, a catching part configured to come into contact with a part of a front edge of the catching-target part to restrict the shield terminal from moving forward, wherein the catching-target part of the shield terminal lies behind the connecting part.

2. The coaxial connector according to claim 1, wherein the contact part of the shield terminal includes:

a main body surrounding the center terminal and the dielectric body; and a rearmost part lying behind the main body and configured to surround the shield wire.

3. The coaxial connector according to claim 1, wherein the catching part of the housing is configured to surround the center line of the coaxial cable, and wherein the catching-target part of the shield terminal is rotatable over 360 degrees relative to the catching part about the center line of the coaxial cable.

4. The coaxial connector according to claim 1, wherein the catching-target part is configured to lie outside the shield wire.

5. The coaxial connector according to claim 1, wherein at least a part of the catching-target part in the circumferential direction about the center line of the coaxial cable is configured to be away from an outer face of the coaxial cable.

6. A coaxial connector comprising:

a center terminal which is configured to be connected to a core wire of a coaxial cable;

a shield terminal which is configured to be connected to a shield wire of the coaxial cable;

a dielectric body externally surrounding the center terminal, the dielectric body being disposed between the center terminal and the shield terminal; and a housing formed with an insertion hole passing through in a front-rear direction to accommodate the center terminal, the dielectric body, and the shield terminal, the center terminal, the dielectric body, and the shield terminal configured to be inserted into the housing from a rear side of the insertion hole, wherein the shield terminal includes:

a contact part surrounding the center terminal and the dielectric body, the contact part being configured to come into contact with a terminal of a target connector;

a connecting part configured to surround the shield wire of the coaxial cable, the connecting part configured to be connected to the shield wire of the coaxial cable; and a catching-target part configured to surround the coaxial cable, wherein the contact part, the connecting part, and the catching-target part are bent and formed integrally into a cylindrical shape so as to be configured to surround a center line of the coaxial cable, and wherein the housing includes, inside the insertion hole, a catching part configured to come into contact with a part of a front edge of the catching-target part to restrict the shield terminal from moving forward, wherein the catching-target part includes:

at a part of the catching-target part in a circumferential direction about the center line of the coaxial cable, a first curved part connected to the connecting part and curved about the center line; and a second curved part at another part of the catching-target part in the circumferential direction, wherein a distance from the center line to the second curved part is longer than a distance from the center line to the first curved part, and wherein a front edge of the second curved part is in contact with the catching part of the housing.

7. The coaxial connector according to claim 6, wherein the catching part of the housing is configured to surround the center line of the coaxial cable, and wherein the catching-target part of the shield terminal is rotatable over 360 degrees relative to the catching part about the center line of the coaxial cable.

8. The coaxial connector according to claim 6, wherein the catching-target part is configured to lie outside the shield wire.

9. The coaxial connector according to claim 6, wherein at least a part of the catching-target part in the circumferential direction about the center line of the coaxial cable is configured to be away from an outer face of the coaxial cable.

10. A coaxial connector comprising:

a center terminal which is configured to be connected to a core wire of a coaxial cable;

a shield terminal which is configured to be connected to a shield wire of the coaxial cable;

a dielectric body externally surrounding the center terminal, the dielectric body being disposed between the center terminal and the shield terminal; and a housing formed with an insertion hole passing through in a front-rear direction to accommodate the center terminal, the dielectric body, and the shield terminal, the center terminal, the dielectric body, and the shield terminal configured to be inserted into the housing from a rear side of the insertion hole, wherein the shield terminal includes:

a contact part surrounding the center terminal and the dielectric body, the contact part being configured to come into contact with a terminal of a target connector;

a connecting part configured to surround the shield wire of the coaxial cable, the connecting part configured to be connected to the shield wire of the coaxial cable; and a catching-target part configured to surround the coaxial cable, wherein the contact part, the connecting part, and the catching-target part are bent and formed integrally into a cylindrical shape so as to be configured to surround a center line of the coaxial cable, and wherein the housing includes, inside the insertion hole, a catching part configured to come into contact with a part of a front edge of the catching-target part to restrict the shield terminal from moving forward, the coaxial connector further comprising a locking member attached to the housing, the locking member including a catching part lying behind a rear edge of the catching-target part, the catching part being configured to restrict the shield terminal from moving rearward.

11. The coaxial connector according to claim 10, wherein the catching part of the housing is configured to surround the center line of the coaxial cable, and wherein the catching-target part of the shield terminal is rotatable over 360 degrees relative to the catching part about the center line of the coaxial cable.

12. The coaxial connector according to claim 10, wherein the catching-target part is configured to lie outside the shield wire.

13. The coaxial connector according to claim 10, wherein at least a part of the catching-target part in the circumferential direction about the center line of the coaxial cable is configured to be away from an outer face of the coaxial cable.

14. A coaxial connector comprising:

a center terminal which is configured to be connected to a core wire of a coaxial cable;

a shield terminal which is configured to be connected to a shield wire of the coaxial cable;

a dielectric body externally surrounding the center terminal, the dielectric body being disposed between the center terminal and the shield terminal; and a housing formed with an insertion hole passing through in a front-rear direction to accommodate the center terminal, the dielectric body, and the shield terminal, the center terminal, the dielectric body, and the shield terminal configured to be inserted into the housing from a rear side of the insertion hole, wherein the shield terminal includes:

a contact part surrounding the center terminal and the dielectric body, the contact part being configured to come into contact with a terminal of a target connector;

a connecting part configured to surround the shield wire of the coaxial cable, the connecting part configured to be connected to the shield wire of the coaxial cable; and a catching-target part configured to surround the coaxial cable, wherein the contact part, the connecting part, and the catching-target part are bent and formed integrally into a cylindrical shape so as to be configured to surround a center line of the coaxial cable, and wherein the housing includes, inside the insertion hole, a catching part configured to come into contact with a part of a front edge of the catching-target part to restrict the shield terminal from moving forward, wherein the catching-target part lies at a rearmost part of the shield terminal.

15. The coaxial connector according to claim 14, wherein the catching part of the housing is configured to surround the center line of the coaxial cable, and wherein the catching-target part of the shield terminal is rotatable over 360 degrees relative to the catching part about the center line of the coaxial cable.

16. The coaxial connector according to claim 14, wherein the catching-target part is configured to lie outside the shield wire.

17. The coaxial connector according to claim 14, wherein at least a part of the catching-target part in the circumferential direction about the center line of the coaxial cable is configured to be away from an outer face of the coaxial cable.

18. A coaxial connector comprising:

a center terminal which is configured to be connected to a core wire of a coaxial cable;

a shield terminal which is configured to be connected to a shield wire of the coaxial cable;

a dielectric body externally surrounding the center terminal, the dielectric body being disposed between the center terminal and the shield terminal; and a housing formed with an insertion hole passing through in a front-rear direction to accommodate the center terminal, the dielectric body, and the shield terminal, the center terminal, the dielectric body, and the shield terminal configured to be inserted into the housing from a rear side of the insertion hole, wherein the shield terminal includes:

a contact part surrounding the center terminal and the dielectric body, the contact part being configured to come into contact with a terminal of a target connector;

a connecting part configured to surround the shield wire of the coaxial cable, the connecting part configured to be connected to the shield wire of the coaxial cable; and a catching-target part configured to surround the coaxial cable, wherein the contact part, the connecting part, and the catching-target part are bent and formed integrally into a cylindrical shape so as to be configured to surround a center line of the coaxial cable, and wherein the housing includes, inside the insertion hole, a catching part configured to come into contact with a part of a front edge of the catching-target part to restrict the shield terminal from moving forward, wherein, inside the connecting part of the shield terminal, a supporting member having a cylindrical shape, which is configured to surround the shield wire, is disposed.

19. The coaxial connector according to claim 18, wherein the connecting part of the shield terminal is configured to be disposed outside a folded part of the shield wire, which folded part is folded outward of the supporting member.

20. The coaxial connector according to claim 18, wherein the supporting member includes:

a shield wire holding part which is configured to surround the shield wire to hold the shield wire; and an outer coat holding part which is configured to surround an outer coat of the coaxial cable to hold the outer coat.

21. The coaxial connector according to claim 20, wherein the catching-target part of the shield terminal lies outside the outer coat holding part so as to be away from the outer coat holding part in a radial direction of the coaxial cable.

22. The coaxial connector according to claim 18, wherein the catching part of the housing is configured to surround the center line of the coaxial cable, and wherein the catching-target part of the shield terminal is rotatable over 360 degrees relative to the catching part about the center line of the coaxial cable.

23. The coaxial connector according to claim 18, wherein the catching-target part is configured to lie outside the shield wire.

24. The coaxial connector according to claim 18, wherein at least a part of the catching-target part in the circumferential direction about the center line of the coaxial cable is configured to be away from an outer face of the coaxial cable.

* * * * *